US005799337A

United States Patent [19]

Brown

[11] Patent Number: 5,799,337

[45] Date of Patent: Sep. 1, 1998

[54] FACE GUARD ATTACHED CHINSTRAP FOR AN ATHLETIC HELMET

[76] Inventor: Lowell Brown, 82 Kincardine Dr., Bella Vista, Ark. 72715

[21] Appl. No.: 969,985

[22] Filed: Nov. 13, 1997

Related U.S. Application Data

[60] Provisional application No. 60/031,333 Nov. 20, 1996.

[51] Int. Cl.[6] ..... A42B 3/08; A42B 3/18

[52] U.S. Cl. ..... 2/421; 2/424; 2/425

[58] Field of Search ..... 2/421, 9, 410, 2/411, 422, 424, 425

[56] References Cited

U.S. PATENT DOCUMENTS

| | | | |
|---|---|---|---|
| 2,881,442 | 4/1959 | Sowie | 2/9 |
| 3,113,318 | 12/1963 | Marietta | 2/9 |
| 3,916,446 | 11/1975 | Gooding . | |
| 4,651,356 | 3/1987 | Zide | 2/421 |
| 4,692,947 | 9/1987 | Tomczak | 2/421 |
| 5,249,347 | 10/1993 | Martinitz | 2/9 |
| 5,347,660 | 9/1994 | Zide | 2/421 |

*Primary Examiner*—Michael A. Neas

*Attorney, Agent, or Firm*—Gene Scott —Patent Law & Venture Group

[57] ABSTRACT

A protective helmet most useful in the sport of football includes a helmet shell for enclosing a head of the wearer and further includes a face guard attached to the helmet shell and extending in front of a face opening in the helmet. A chin cup is mounted by a pair of straps. One of the straps is fastened to the sides of the helmet. The other of the straps is fastened to the face guard at lateral positions so that forces directed to the face guard are transferred to the wearer's chin directly.

4 Claims, 1 Drawing Sheet

FACE GUARD ATTACHED CHINSTRAP FOR AN ATHLETIC HELMET

This application claims the filing date priority of a prior filed provisional patent application, Ser. No. 60/031,333 having a filing date of Nov. 20, 1996 in that the subject matter of both applications is largely identical.

BACKGROUND OF THE INVENTION

1. Field of the Invention

This invention relates generally to protective helmets, and more particularly to an athletic helmet having a chinstrap attached to a face guard of the helmet.

2. Description of Related Art

The following art defines the present state of this field:

Zilde, U.S. Pat. No. 4,651,356 describes a unitized chin strap for football helmets and the like is molded from an elastomer possessing elastic memory. The device includes a protective chin cup which is curved on two axes and is adapted to receive an apertured chin cushioning pad which allows the tip of the chin to be safely suspended in a space defined by the chin strap cup. The cup gradually diminished in thickness and rigidity from the center of the cup toward its marginal edge. Divergent axis relatively flexible and somewhat stretchable straps are joined to the sides of the chin cup by relatively wide twist-resistant strap-to-cup joint portions. Conventional buckles having snap fastener components are slidably engaged on the straps of the device to provide a secure four point attachment of the chin strap to a helmet. The device substantially eliminates movement of the helmet on the head during use, thereby greatly reducing the likelihood of severe injury.

Zilde, U.S. Pat. No. 5,347,660 describes an adjustable high/low hook-up chin strap for an athletic helmet, wherein a pair of continuous straps having adjustable fasteners are fixedly connected to a chin cup. One of the straps is provided with a pair of spaced, longitudinally extending slits through which extend end portions of the other strap to provide a cross-over at each end of the chin cup. The slits are dimensioned to allow the other strap to slidably move therein through at least a +/−35 degree arc so that the adjustable fasteners thereon can be connected to the high hook-ups in the helmet regardless of their lower or higher position relative to the lower hook-ups, ups, and each strap can be independently tightened with its respective adjustable fasteners.

Black, U.S. Pat. No. 4,692,947 describes a protective headgear comprising, a shell for receiving a wearer's head, and a cup to receive the wearer's chin. The headgear has a strap connecting the cup to the shell, with the strap having a first strap segment with one end fixedly attached to the shell and extending to the cup, and a second strap segment having one end releasably attached to the shell and extending to the cup.

Gooding, U.S. Pat. No. 3,916,446 describes this invention relates to a chin cup and strap assembly consisting of a double knit fabric cup assembly and stretchable nylon straps with suitable fasteners for attachment to various occupational protective headgear. By virtue of its unique characteristics and fabrication, the double knit chin cup will conform to the physical shape of the chin of any wearer. The chin cup may have an inner member of impact absorbing material best suited for a particular application. Affixed to each end of the chin cup are stretchable nylon fabric straps having the proper yieldability for the use intended. The yieldability of both the chin cup and the chin straps coact to attain the desired degree of retention of the protective headgear to which they are attached and thereby afford a degree of comfort and safety heretofore not available.

The prior art, as shown in Zide, Gooding and Black et al, teaches that a chin strap for a protective helmet may be attached to the helmet and is preferably attached to the helmet at two spaced apart locations so that the strap is more securely fixed into position and the helmet is securely tightened on the head of the wearer. However, the prior art does not teach that it is preferably to attach at least one of the straps to the face guard of the helmet nor does it teach the preferably manner of fixing such. The present invention fulfills these needs and provides further related advantages as described in the following summary.

SUMMARY OF THE INVENTION

The present invention teaches certain benefits in construction and use which give rise to the objectives described below.

The invention teaches a protective helmet having usefulness primarily in the sport of football and it includes a helmet shell for enclosing a head of the wearer and further includes a face guard attached to the helmet shell and extending in front of a face opening in the helmet. A chin cup is mounted by a pair of straps. One of the straps is fastened to the sides of the helmet. The other of the straps is fastened to the face guard.

A primary objective of the present invention is to provide a protective helmet having advantages not taught by the prior art.

Another objective is to provide such a helmet wherein a chin strap is fastened to a face guard of the helmet so as to enable forces directed to the face guard to be transferred to the chin directly and not through a fastener supporting the face guard on the helmet.

A further objective is to provide such a helmet wherein the chin strap is adjustable so as to assure that the helmet is fitted on the head of the wearer tightly and safely.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
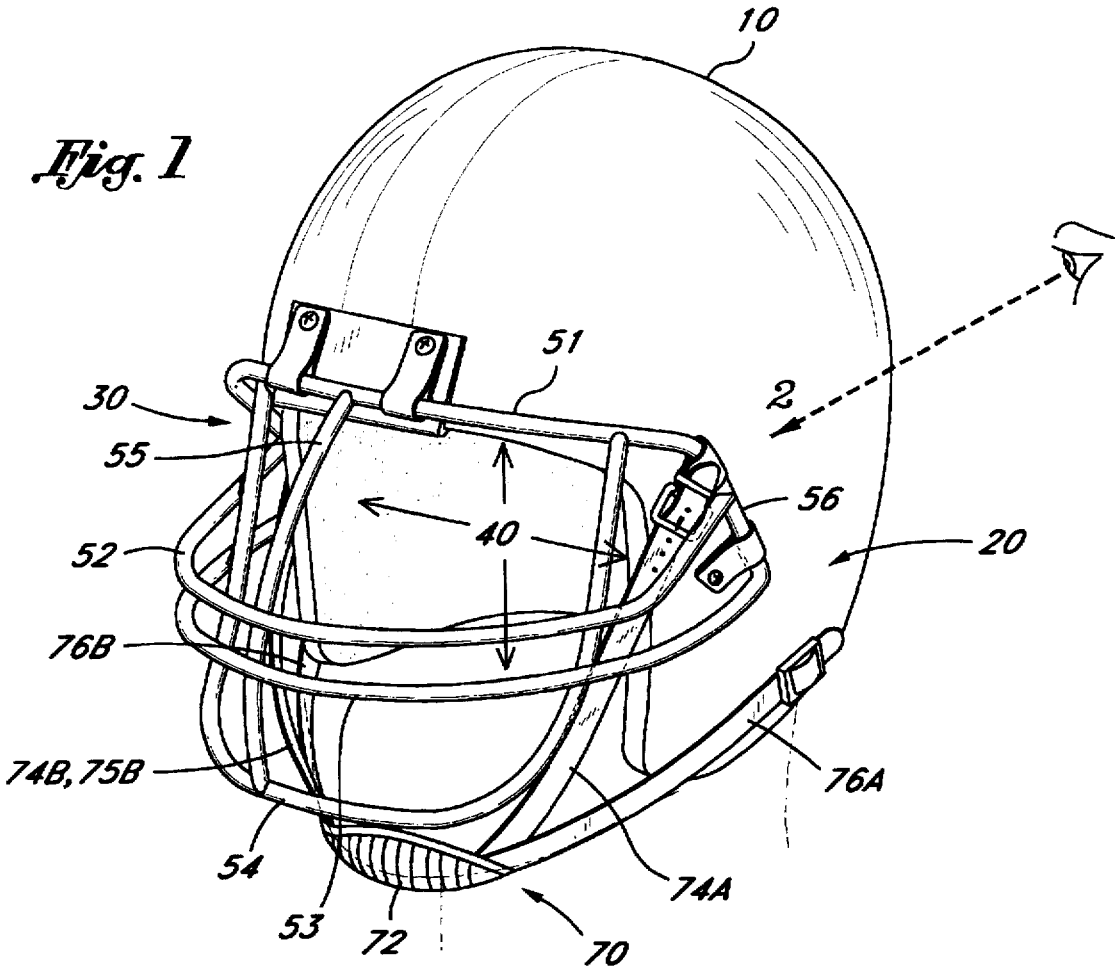
FIG. 1 is a perspective view of the preferred embodiment of the present invention.

The above described drawing figures illustrate the invention, a protective headgear device as shown in FIG. 1, comprising a helmet 10 for receiving a wearer's head, and having opposed sides 20, and a front portion 30 defining a face opening 40. A face guard 50 comprising a mutually joined plurality of rigid wires 51, 52, 53, 54, 55 and 56 is attached to the helmet 10 and extends in front of, and around the face opening 40, the rigid wires 51–56 include a pair of laterally placed, upwardly angled, side wires 56, each of which are held adjacent to one of the opposed sides 20 of the helmet 10, and further includes a forwardly positioned front wire 52 positioned in front of the face opening 40 joining the side wires at a position 60 generally above the wearer's eyes (not shown).

A chinstrap assembly 70 includes a chin cup 72 positioned over the wearer's chin. Extending from the chin cup 72 are a pair of upper lateral straps 74A and 74B, each directed to and joined with one of the side wires 56 just above the front wire 52. A pair of lower lateral straps 76A and 76B, are directed to and joined with one of the opposed sides 20 of the helmet 10 such that the force of a blow to the face guard 50 is transferred directly through the upper lateral straps 74A and 74B to the chin cup 72.

Preferably, the upper lateral straps 74A and 74B each comprise an interconnection strap portion 75A and 75B respectively integrally joined with the chin cup 72 and a fastener strap portion 76A and 76B (not shown) fastened integrally to one of the side wires 56, the interconnection strap portion and the fastener strap portion providing means for mutual adjustable attachment 77A.

Figure 2:
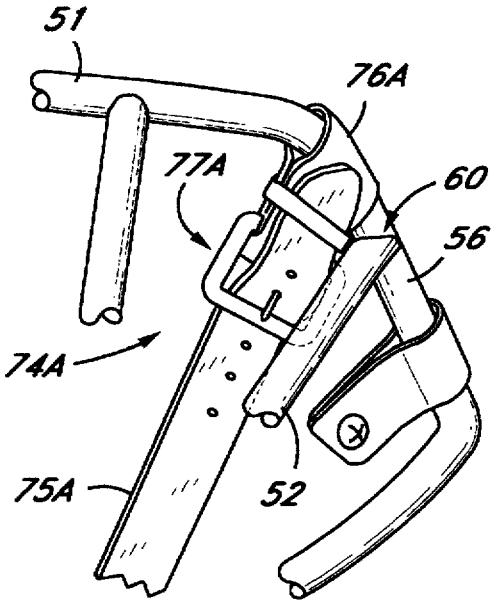
FIG. 2 is a partial view of FIG. 1 taken in accordance with line 2 in FIG. 1.

The mutual adjustable attachment means 77A is preferably a buckle and a plurality of fastener holes as with the fastening of a common belt buckle, the buckle providing a tongue for engagement in a selected one of the fastener holes as shown in FIG. 2.

Figure 3:
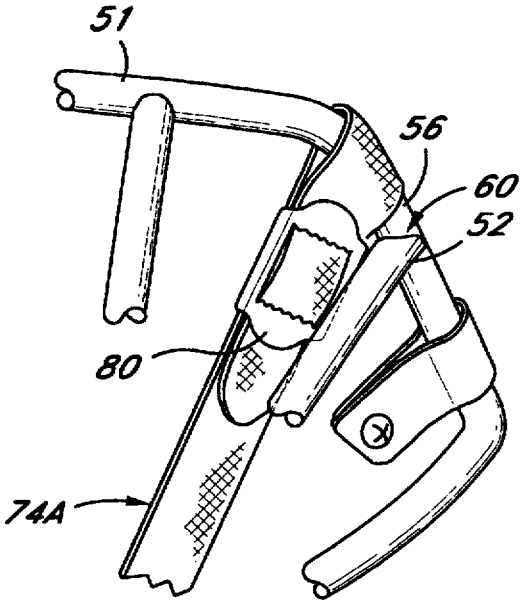
FIG. 3 is identical to FIG. 2 but showing an alternate fastening means.

Alternately the upper lateral straps 74A, 74B each comprise an interconnection strap portion 75A, 75b integrally joined with the chin cup and also looped about one of the side wires 56, the interconnection strap portion being held at a selected tension by a toothed buckle 80 as shown in FIG. 3, While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A protective headgear device comprising:

a helmet for receiving a wearer's head, and having opposed sides, and a front portion defining a face opening;

a face guard comprising a mutually joined plurality of rigid wires attached to the helmet and extending in front of, and around the face opening, the rigid wires including a pair of laterally placed, upwardly angled, side wires, each of the side wires held adjacent to one of the opposed sides of the helmet, and a forwardly positioned front wire positioned in front of the face opening and joining the side wires at a position generally above the wearer's eyes;

a chinstrap assembly including a chin cup positioned over the wearer's chin, and extending from the chin cup, a pair of upper lateral straps, each directed to and joined with one of the side wires just above the front wire, and a pair of lower lateral straps, each directed to and joined with one of the opposed sides of the helmet such that the force of a blow to the face guard is transferred directly through the upper lateral straps to the chin cup.

2. The device of claim 1 wherein the upper lateral straps each comprise an interconnection strap portion integrally joined with the chin cup and a fastener strap portion fastened integrally to one of the side wires, the interconnection strap portion and the fastener strap portion providing means for mutual adjustable attachment.

3. The device of claim 2 wherein the mutual adjustable attachment means is a buckle and a plurality of fastener holes, the buckle providing a tongue for engagement in a selected one of the fastener holes.

4. The device of claim 1 wherein the upper lateral straps each comprise an interconnection strap portion integrally joined with the chin cup and also looped about one of the side wires, the interconnection strap portion being held at a selected tension by a toothed buckle.

* * * * *